US005562483A

United States Patent [19]

Hoffman

[11] Patent Number: 5,562,483

[45] Date of Patent: Oct. 8, 1996

[54] ELECTRICAL WIRING DEVICE WITH CONDUIT CLAMPING MECHANISM

[75] Inventor: Ernest G. Hoffman, Middlefield, Conn.

[73] Assignee: Hubbell Incorporated, Orange, Conn.

[21] Appl. No.: 353,699

[22] Filed: Dec. 12, 1994

[51] Int. Cl.[6] ..... H01R 13/58

[52] U.S. Cl. ..... 439/469; 439/472

[58] Field of Search ..... 439/469, 459, 439/472

[56] References Cited

U.S. PATENT DOCUMENTS

| | | | |
|---|---|---|---|
| 2,577,748 | 12/1951 | Gillespie | 285/6.5 |
| 2,911,616 | 11/1959 | Townsend | 439/814 |
| 3,402,382 | 9/1968 | De Tar | 439/469 |
| 3,437,980 | 4/1969 | Smith | 439/469 |
| 3,784,961 | 1/1974 | Gartland, Jr. | 339/107 |
| 3,865,461 | 2/1975 | Ludwig | 339/103 |
| 4,080,036 | 3/1978 | Hagel | 339/103 |
| 4,169,572 | 10/1979 | Simon | 248/56 |
| 4,178,056 | 12/1979 | Lee | 339/103 |
| 4,213,667 | 7/1980 | Wittes | 339/103 |
| 4,419,537 | 12/1983 | Leep et al. | 174/65 |
| 5,021,006 | 6/1991 | Fargeaud et al. | 439/469 |
| 5,217,389 | 6/1993 | MacKay et al. | 439/466 |
| 5,338,222 | 8/1994 | Boteler | 439/469 |
| 5,354,213 | 10/1994 | Hoffman | 439/469 |

FOREIGN PATENT DOCUMENTS

| | | | |
|---|---|---|---|
| 497811 | 8/1928 | Germany | 439/460 |

*Primary Examiner*—Neil Abrams
*Assistant Examiner*—Eugene G. Byrd
*Attorney, Agent, or Firm*—Jerry M. Presson; David L. Tarnoff

[57] ABSTRACT

An electrical wiring device having a mechanism for clamping conduits of various diameters. The wiring device includes an electrical connector having a passageway for receiving conduit therein, and a clamping mechanism securely coupled thereto for clamping conduits having a variety of diameters. The clamping mechanism has at least one outwardly extending member and rotates 90° between first and second positions. When the clamping mechanism is in its first position, it clamps conduit having a large diameter. When the clamping mechanism is in its second position, the outwardly extending member thereon clamps conduit having a smaller diameter. The clamping mechanism is snap-fitted to the connector which allows relative rotary and slight axial movement therebetween. Teeth on the connector and clamping mechanism prevent relative rotary movement when engaged, and can be disengaged by axially moving the clamping mechanism.

22 Claims, 6 Drawing Sheets

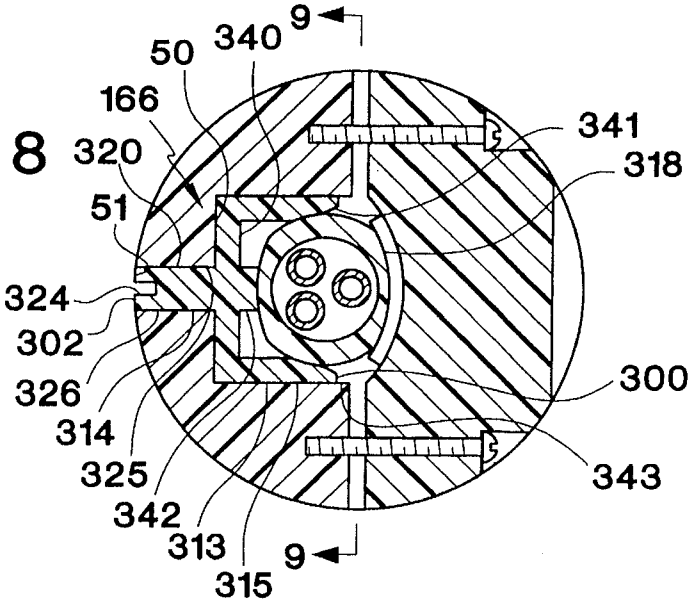
FIG. 8
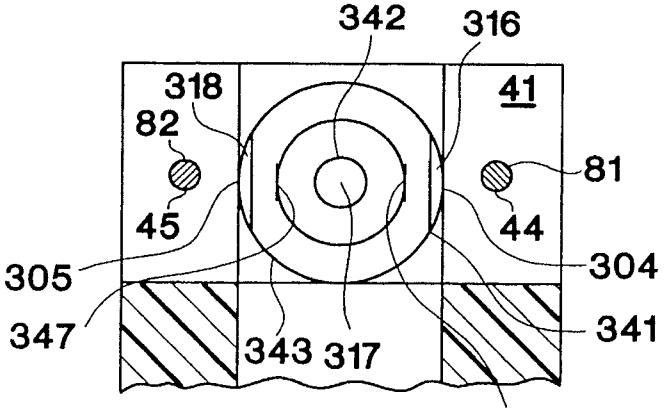
FIG. 9
FIG. 6
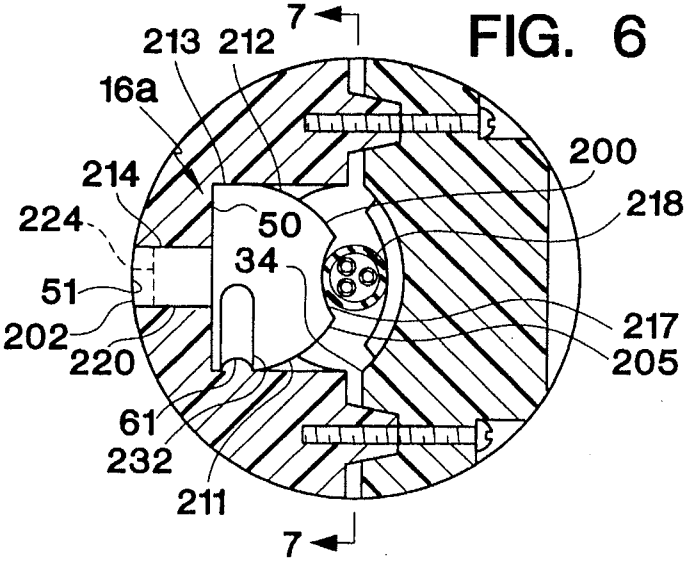
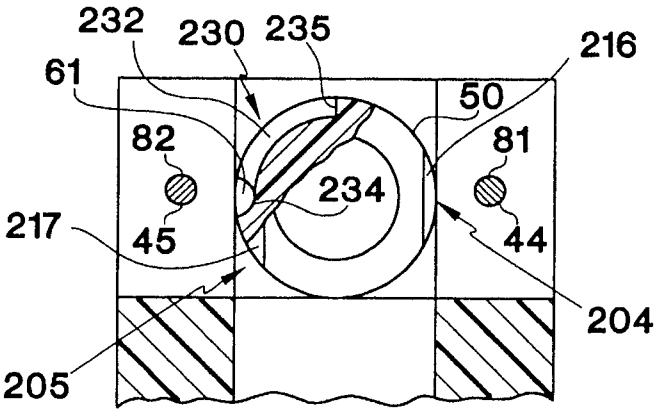
FIG. 7

FIG. 15
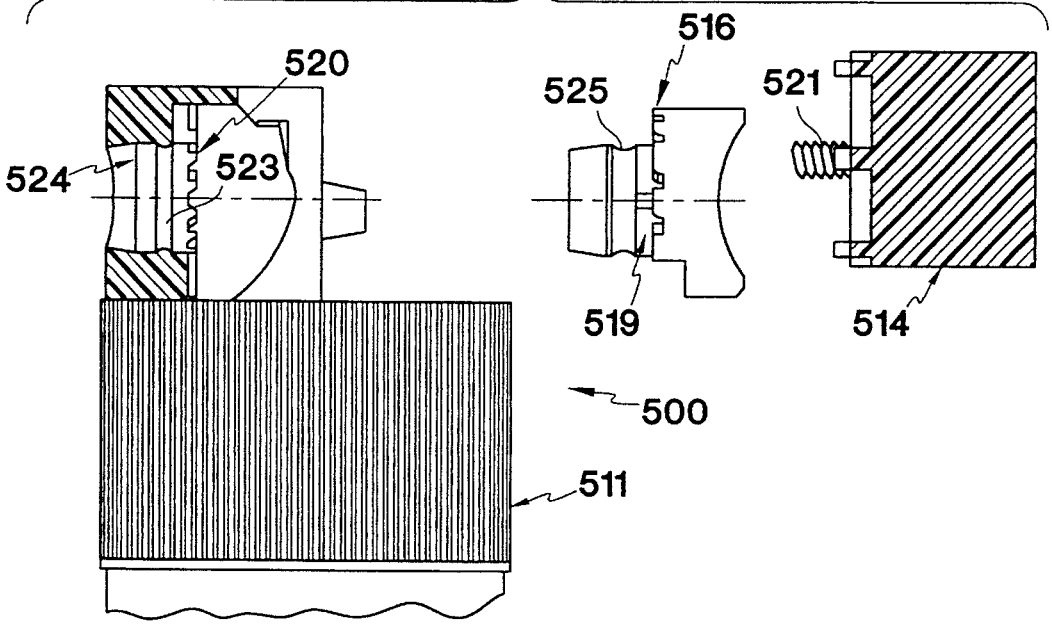
FIG. 16
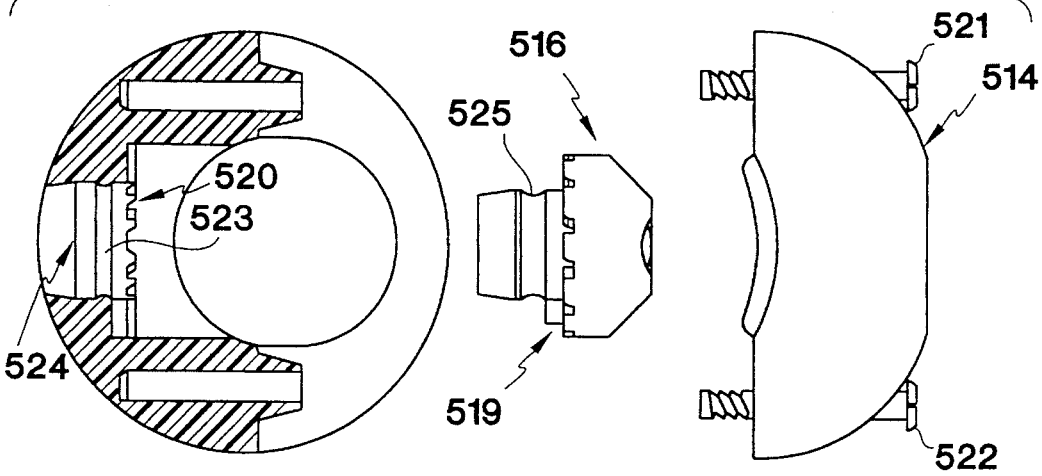
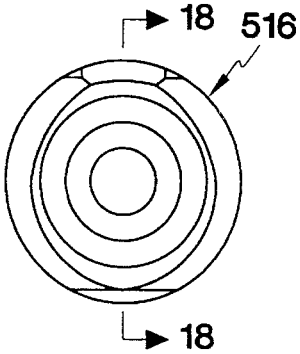
FIG. 17
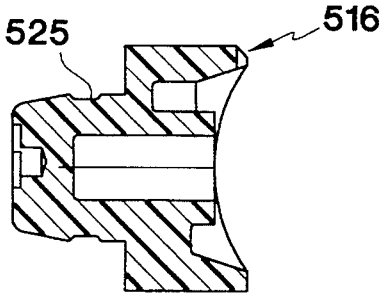
FIG. 18

ELECTRICAL WIRING DEVICE WITH CONDUIT CLAMPING MECHANISM

FIELD OF THE INVENTION

This invention relates to an electrical wiring device which includes a clamping mechanism for coupling electrical conduits or cords of varying diameters within an electrical connector. More specifically, the invention relates to a cord clamping mechanism, capable of rotary movement only, or mainly rotary movement with slight axial movement, and which has a saddle-shaped member for alternatively clamping cord having small or large diameters within an electrical connector.

BACKGROUND OF THE INVENTION

Typically, an electrical cord or conduit is coupled within an electrical connector by a movable conduit jaw. An example of such a jaw is disclosed in Gartland U.S. Pat. No. 3,784,961, the disclosure of which is hereby incorporated herein by reference.

Such jaws are able to grip and secure only one general size of conduit. However, various sizes of conduit are used for different applications.

The conventional means for accommodating a wide range of conduit diameters has been to use a removable or expendable conduit clamp, i.e., one that is used only when smaller diameter cable is used and removed when larger diameter cable is used. The clamp reduces the opening size of the electrical connector, thereby allowing the conduit clamp to effectively grip the smaller diameter cable within the opening.

Such removable clamps have several disadvantages. The electrical connectors leave the factory with the clamps installed and ready to receive smaller diameter conduit. Thus, if the user forgets to remove the clamp or does not realize removal is necessary and attempts to use larger diameter conduit, the conduit may be damaged. Furthermore, removable clamps are easily lost.

Alternatively, permanent clamps have been used, but they require both rotary and translational movement to be effective.

Examples of some prior clamps are disclosed in the following U.S. Pat. Nos. 2,577,748 to Gillespie; 2,911,616 to Townsend; 3,402,382 to DeLar; 3,437,980 to Smith; 3,865,461 to Ludwig; 4,080,036 to Hagel; 4,178,056 to Lee; 4,213,667 to Wittes; and 5,021,006 to Fargeaud et al.

Thus, a need exists to provide an improved electrical wiring device with a clamp capable of gripping various sizes of electrical conduit. This invention addresses this need in the art, along with other needs which will become apparent to those skilled in the art once given this disclosure.

SUMMARY OF THE INVENTION

Accordingly, a primary object of the invention is to provide a conduit clamping mechanism that is usable with either a large or small diameter conduit.

Another object of the invention is to provide a conduit clamping mechanism that reduces the diameter opening of the connector without any, or with only slight, linear translation of the clamping mechanism.

Another object of the invention is to provide a conduit clamping mechanism that is securely coupled within the body or jaw of an electrical wiring device, and thus, cannot be lost.

A further object of the invention is to provide a conduit clamping mechanism that must be activated before the smaller diameter conduit is usable, and thus, does not damage the larger diameter conduit.

The foregoing objects are basically attained by providing an electrical wiring device, the combination comprising: a housing having a longitudinal axis, and a passageway for receiving an electrical conduit therein, the passageway having a wall; a clamping mechanism, coupled to the housing for rotary movement, for selectively clamping electrical conduit having different diameters against the wall, the clamping mechanism having a first end and a second end, and a first member coupled thereto, the clamping mechanism having a first position and a second position, the first end clamping an electrical conduit having a large diameter when the clamping mechanism is in the first position, and the first member clamping an electrical conduit having a smaller diameter when the clamping mechanism is in the second position; a locking mechanism, coupled to the housing and clamping mechanism, for preventing relative rotational movement of the clamping mechanism and the housing; and a mechanism, coupled to the housing and clamping mechanism, for engaging and disengaging the locking mechanism.

Other objects, advantages and salient features of the invention will become apparent from the following detailed description which, taken in conjunction with the annexed drawings, discloses five embodiments of the invention.

BRIEF DESCRIPTION OF THE DRAWINGS

Referring now to the drawings which form part of this original disclosure:

FIG. 6 is similar to FIG. 4, but shows a second embodiment of the clamping mechanism;

FIG. 7 is a cross-sectional view of the electrical wiring device taken along line 7—7 of FIG. 6 with the clamping mechanism partially broken away;

FIG. 8 is similar to FIG. 3, but shows a third embodiment of the clamping mechanism;

FIG. 9 is a cross-sectional view of the electrical wiring device taken along line 9—9 of FIG. 8;

FIG. 15 is an exploded side elevational view of the wiring device shown in FIG. 13;

FIG. 16 is an exploded top elevational view of the wiring device shown in FIG. 13;

FIG. 17 is an end elevational view of the clamping mechanism;

FIG. 18 is a side elevational view of the clamping mechanism in section taken along line 18—18 in FIG. 17.

DETAILED DESCRIPTION OF THE INVENTION

Figure 2:
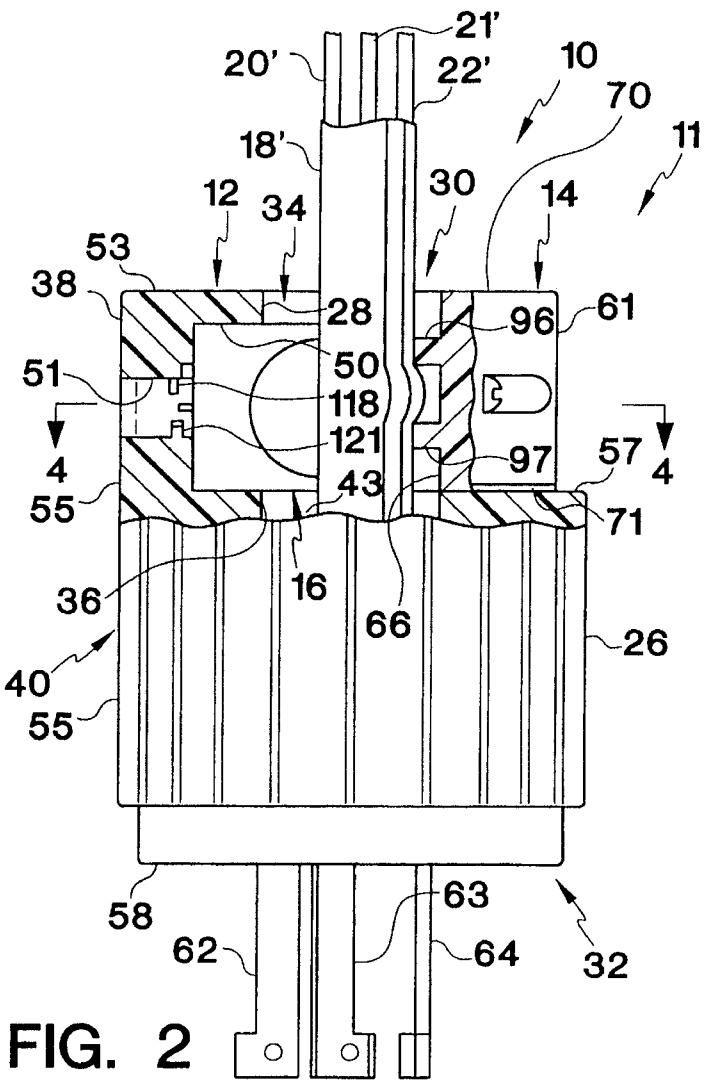
FIG. 2 is a side elevational view of the electrical wiring device with a small diameter conduit coupled therein, and with the body partially broken away to show the coupling mechanism of FIG. 1 rotated 90° and activated to grip the smaller conduit.
Figure 1:
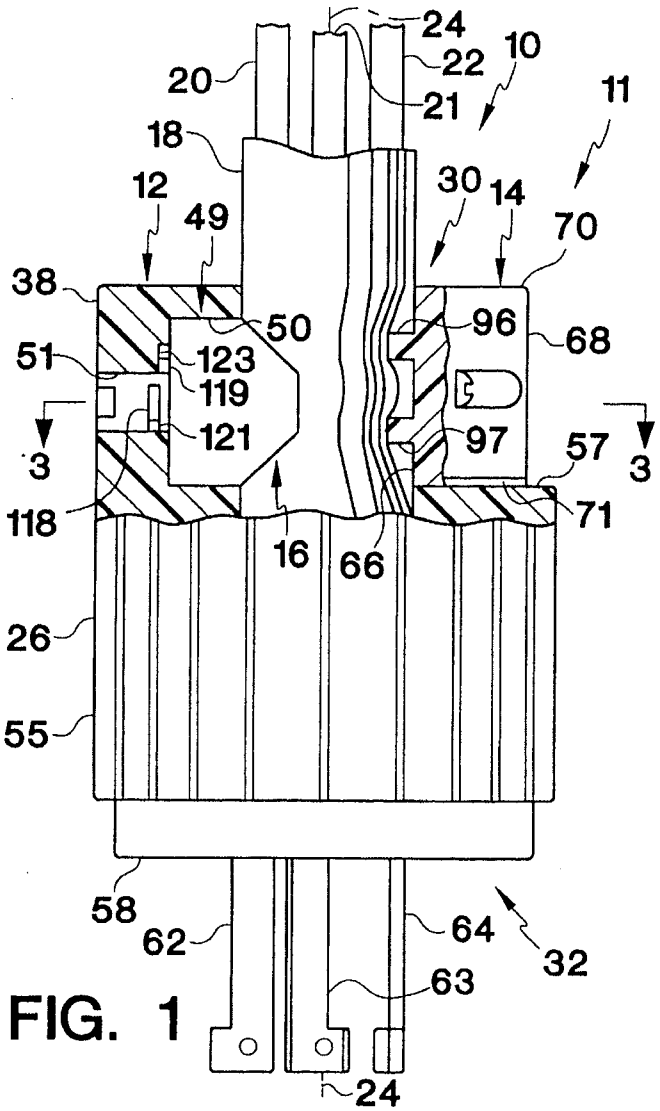
FIG. 1 is a side elevational view of the electrical wiring device with a large diameter conduit coupled therein, and with the body partially broken away to show a first embodiment of the clamping mechanism coupled within the body n accordance with the present invention.

As seen in FIGS. 1–5, an electrical wiring device 10 in accordance with the first embodiment of the present invention is illustrated, and includes a connector or housing 11, and a clamping mechanism 16. Housing 11 comprises a body member 12 and a jaw 14. Jaw 14 and clamping mechanism 16 are coupled to body member 12 for gripping and coupling a conduit within housing 11. Clamping mechanism 16 is capable of clamping or gripping both large and small diameter conduit 18 and 18', as seen in FIGS. 1 and 2, respectively.

Connector 11, except as it is modified to receive clamping mechanism 16, is basically conventional and well known, and thus is not described in great detail. An example of such a connector 11 is disclosed in U.S. Pat. No. 3,784,961 to Gartland previously incorporated herein by reference.

Connector 11 may be either male or female. If a male connector is used as shown, conductive contacts 62–64 extend outwardly and perpendicularly from second end 32 of the connector. Contacts 62–64 are formed of metal and are electrically connected in a conventional manner to conductors 20–22, which are located within conduit 18.

Body member 12, as seen in FIGS. 1–4, is formed of rigid plastic, is substantially cylindrical and thus has a circular cross section. Body member 12 has a longitudinal axis 24, an outer surface 26, an inner surface 28, a first end 30, a second end 32, and a passageway 34. Passageway 34 is substantially cylindrical and is defined by wall 36 formed by body member 12 and jaw 14.

Body member 12 receives conduit 18 or 18' at first end 30, and receives the conduit within passageway 34.

Body member 12 has a semi-cylindrical portion 38 extending axially along longitudinal axis 24 from first end 30 partially toward second end 32. Semi-cylindrical portion 38 comprises approximately one-third of body member's total length from first end 30 to second end 32. Semi-cylindrical portion 38 is the only portion of body member 12 that is not completely cylindrical.

Semi-cylindrical portion 38, as best seen in FIGS. 1–4, is unitarily and integrally connected to cylindrical portion 40 of body member 12. Semi-cylindrical portion 38 has flat surfaces 41 and 42, a semi-cylindrical recess 43, and first and second ends 53 and 55.

Flat surfaces 41 and 42 extend between first end surface 53 to second end surface 55 of semi-cylindrical portion 38. Both flat surfaces 41 and 42 are co-planar and extend parallel to longitudinal axis 24.

Each flat surface 41 and 42 has an aperture 44 and 45 extending transversely therethrough, respectively. First and second apertures 44 and 45 are perpendicular to the longitudinal axis 24. The apertures 44 and 45 receive screws 81 and 82, respectively, from jaw 14. Flat surfaces 41 and 42 thereby couple body member 12 to jaw 14.

Recess 43 extends arcuately between flat surfaces 41 and 42, and extends from semi-cylindrical portion's first end surface 53 to its second end surface 55 radially from longitudinal axis 24, and comprises a portion of cylindrical passageway 34.

Preferably, semi-cylindrical portion 38 also has a cut-out portion 49 extending perpendicularly to longitudinal axis 24 through semi-cylindrical portion 38. Alternatively, cut-out portion 49 may be formed in jaw 14, but will be discussed primarily with respect to semi-cylindrical portion 38.

Cut-out portion 49 couples clamping mechanism 16 within body member 12, and has a first cylindrical portion 50 and a second cylindrical portion 51 which receive first and second cylindrical portions of clamping mechanism 16 discussed in detail below. First cylindrical portion 50 extends through wall 36 and opens into passageway 34. Second cylindrical portion 51 extends from the end of first cylindrical portion 50 within semi-cylindrical portion 38 through to outer surface 26. First cylindrical portion 50 has a larger diameter than second cylindrical portion 51.

Figure 11:
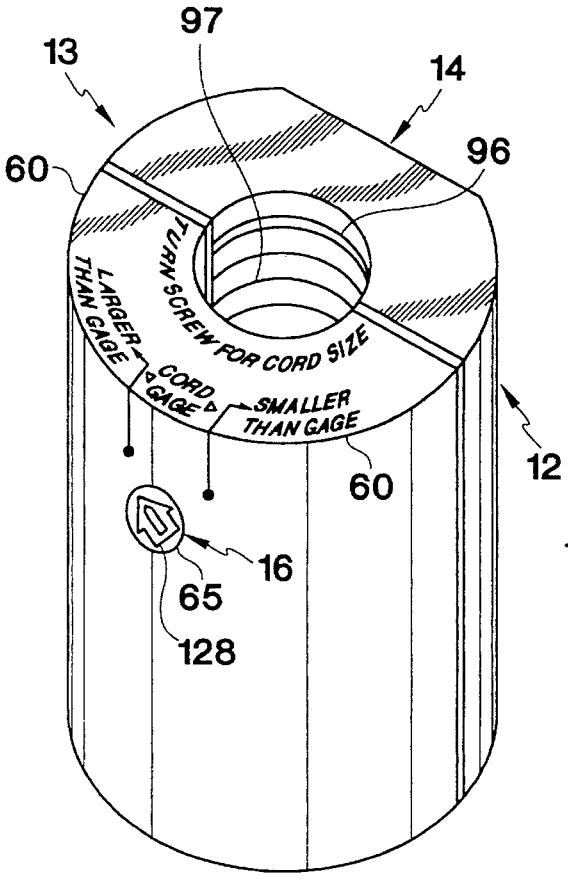
FIG. 11 is a perspective view of the connector showing the clamping mechanism inserted therein, and the indicia indicating the clamping mechanism is in its first position.
Figure 12:
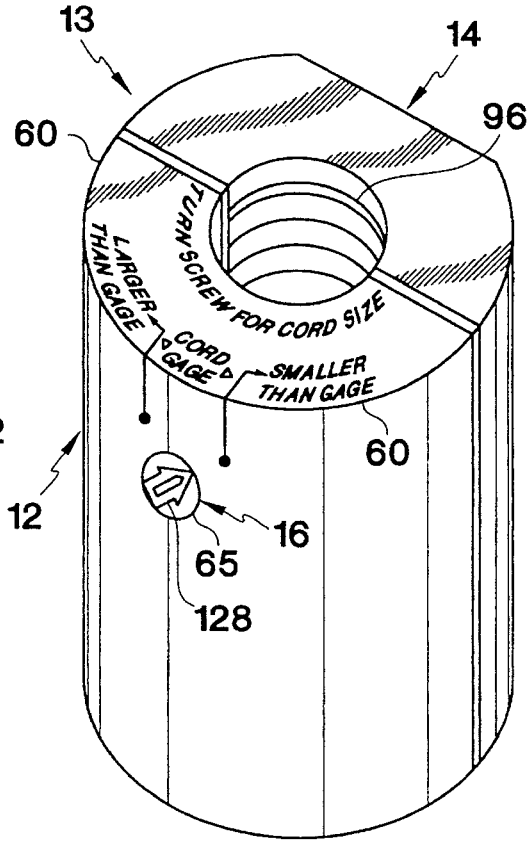
FIG. 12 is a perspective view of the connector body with the clamping mechanism inserted therein and showing indicia indicating the clamping mechanism is in the second position.
Figure 14:
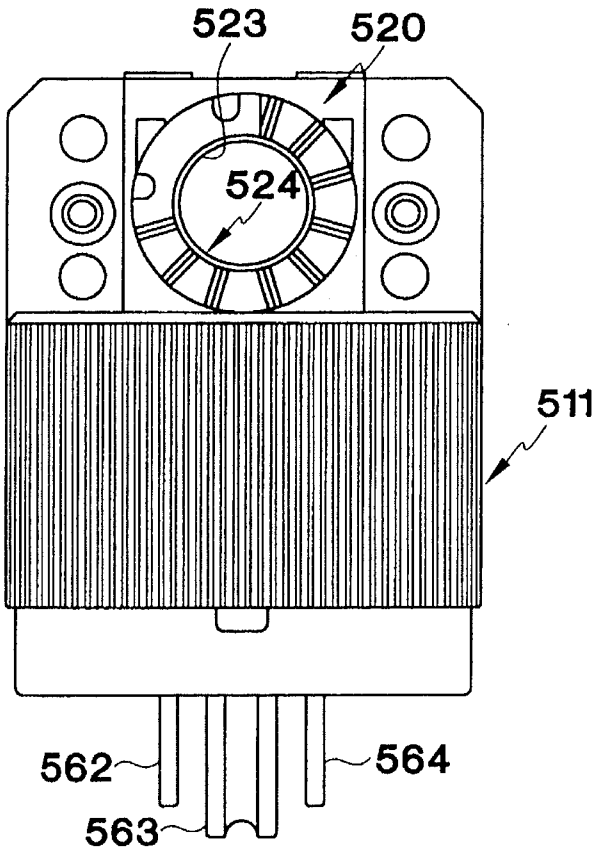
FIG. 14 is an end elevational view of the connector shown in FIG. 13 without the clamping mechanism or movable jaw.

As seen in FIGS. 11 and 12, body member 12 has indicia 60 located on its outer surface 26. Indicia 60 correspond to the first and second positions of clamping mechanism 16, discussed in detail below.

Jaw 14 is conventional and well-known. Jaw 14, as used with electrical wiring device 10 herein, is disclosed in the Gartland patent previously mentioned, and thus, will not be discussed in great detail.

As seen in FIGS. 1–4, jaw 14 acts with clamping mechanism 16 to grip and couple conduit 18 or 18' within passageway 34. Jaw 14 has an inner surface 66, an outer surface 68, and first and second end surfaces 70 and 71. Jaw 14 is formed of rigid plastic, and is substantially semi-cylindrical. Jaw 14 is adjustably coupled to connector 11 at its first end 30.

Inner surface 66 of jaw 14 extends perpendicularly to longitudinal axis 24 and from the jaw's first end 70 to its second end 71. First and second flanges 96 and 97 extend outwardly and perpendicularly from inner surface 66. Flanges 96 and 97 are spaced apart, parallel, and preferably extend transversely to longitudinal axis 24.

Outer surface 68 has a first, second and third portion 73–75. Second portion 74 is flat, extends perpendicularly to longitudinal axis 24, and has a top edge 76 and a bottom edge 77. First and third portions 73 and 75, respectively, extend arcuately from second portion 74 and downwardly toward longitudinal axis 24. First portion 73 extends from top edge 75 of second portion 74, and third portion 75 extends from bottom edge 76 of second portion 74.

First and third portions 73 and 75 have first and second cut-outs 90 and 91 therein, respectively. Cut-outs 90 and 91 have first and second supporting surfaces 93 and 94, respectively. Surfaces 93 and 94 are perpendicular to longitudinal axis 24 and support screw heads 84 and 85.

First and second apertures 78 and 79 extend perpendicularly to longitudinal axis 24 from first and second cut-outs 90 and 91, respectively, to inner body engaging surface 66 through jaw 14. Apertures 78 and 79 are parallel and spaced the same distance apart as apertures 44 and 45.

Screws 81 and 82 are inserted within apertures 78 and 79, respectively. Jaw 14 is then secured to body member 12 as screw body 87 is threadedly received within aperture 44 and screw body 88 is received within second aperture 45. Tightening screws 81 and 82 secure jaw 14 to body member 12.

Conduit clamping mechanism 16 allows housing 11 to be used with various sizes of conduit. Clamping mechanism 16 is unitarily formed from rigid plastic. Preferably, clamping mechanism 16 is fixedly coupled within cut-out 49 to body member 12; however, it may be coupled to jaw 14.

A first embodiment of clamping mechanism 16 is shown in FIGS. 1–5. Clamping mechanism 16 has a first substantially saddle-shaped end 100, a second end 102, and first and second cylindrical portions 113 and 114. First and second members 104 and 105, which are diametrically opposed, form saddle-shaped end 100.

First cylindrical portion 113 extends to first end 100. Second cylindrical portion 114 is rigidly and unitarily coupled to first cylindrical portion 113 and extends from first cylindrical portion 113 to second end 102. On second cylindrical portion 114 are a recess 118 and a detent 119. Recess 118 snaps into ring 121 in cylindrical portion 51 in the connector 11 to rotatably connect clamping mechanism 16 to connector 11 as seen in FIGS. 1–4. Detent or extension 119 alternately engages stops 122 and 123 at opposite ends of arcuate recess 127 to limit rotation of the clamping mechanism 16 to 90° between its first and second positions.

Preferably, first and second members or teeth 104 and 105 extend perpendicularly and outwardly from first cylindrical portion 113 to grip a smaller diameter conduit 18' and couple it within passageway 34 as seen in FIG. 2. However, one member is sufficient.

First and second members 104 and 105 are diametrically opposed and are tapered. Thus, they are thickest where they are fixedly coupled to first cylindrical portion 113, and become narrower until they reach their end surfaces 116 and 117, respectively. First and second end surfaces 116 and 117 are flat, parallel, and spaced apart.

Second cylindrical portion 114 preferably has a smaller diameter than first cylindrical portion 113 and acts as a rotating mechanism having first and second ends 125 and 126. First end 125 is fixedly and unitarily coupled to first cylindrical portion 113. Second end 126 has a recess or groove 124 therein. Recess 124 typically extends across a diameter of second cylindrical portion 114, and receives a tool capable of providing rotary movement to clamping mechanism 16, such as a screwdriver.

As seen in FIGS. 11 and 12, indicia 128 aligns with indicia 60 of body member 12 to indicate which position 110 or 111 clamping mechanism 16 is in.

Figure 4:
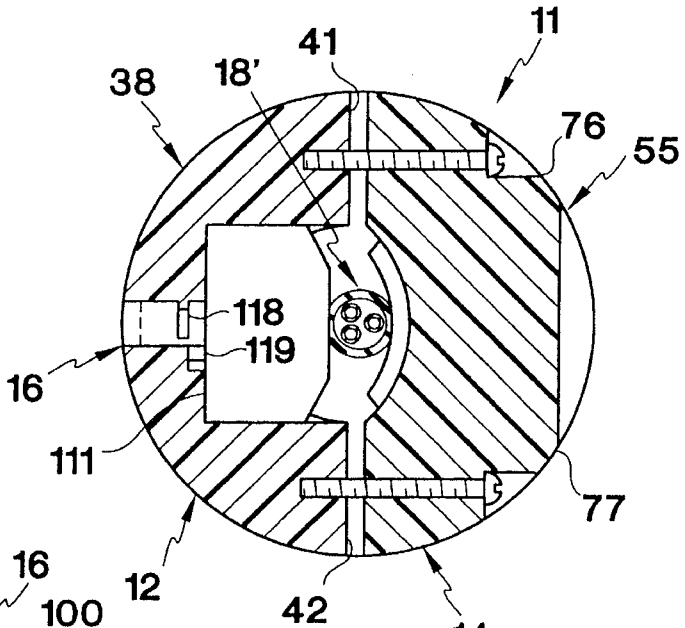
FIG. 4 is a cross-sectional view of the electrical wiring device taken along line 4—4 of FIG. 2 with the clamping mechanism shown in full.
Figure 5:
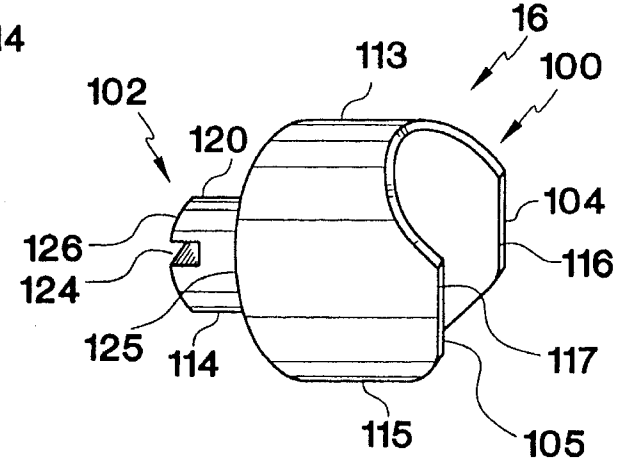
FIG. 5 is a perspective view of the clamping mechanism of FIG. 1–4.
Figure 3:
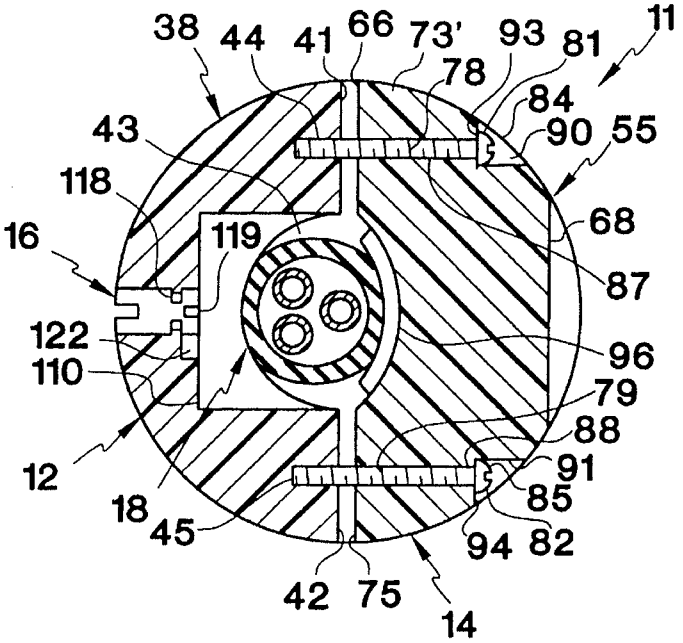
FIG. 3 is a cross-sectional view of the electrical wiring device taken along line 3—3 of FIG. 1 with the clamping mechanism shown in full.

Clamping mechanism 16 rotates 90° between a first and second position as seen in FIGS. 1–4. When clamping mechanism 16 is in its first position, as seen in FIGS. 1 and 3, first end 100 engages conduit 18. When clamping mechanism 16 is in its second position, as seen in FIGS. 2 and 4, first and second members 104 and 105 engage smaller conduit 18'.

Thus, when in its first position, clamping mechanism 16 grips a conduit having a large diameter. When in its second position, members 104 and 105, which project outwardly at first end 100, engage a conduit 18' having a smaller diameter.

OPERATION AND ASSEMBLY OF EMBODIMENT OF FIGS. 1–5

Electrical wiring device 10 is manufactured and shipped with clamping mechanism 16 fixedly coupled within cut-out 49 in the first position, and thus, is ready to receive a larger diameter conduit 18 as in FIG. 1. Specifically, first cylindrical portion 113 fits within first cylindrical portion 50 of cut-out 49, and second cylindrical portion 114 fits within second cylindrical portion 51 of cut-out 49.

Jaw 14 is also fixedly coupled to body member 12. Screws 81 and 82 are inserted through apertures 78 and 79, respectively. Apertures 78 and 79, being the same distance apart as apertures 44 and 45, align with one another. In other words, aperture 78 aligns with aperture 44, and aperture 79 aligns with aperture 45.

Screws 81 and 82 have sufficiently long bodies 87 and 88, respectively, that they extend beyond inner body engaging surface 66 of jaw 14. Thus, screw 81 extends into aperture 44, and screw 82 extends into aperture 45 of body member 12. Screws 81 and 82 are tightened, and thereby secure jaw 14 to body member 12.

Upon reaching the shipment site, large diameter conduit 18, as seen in FIGS. 1 and 3, is inserted into passageway 34, and conductors 20–22 are electrically connected to contacts 62–64 in a conventional manner.

Screws 81 and 82 are further tightened so that flanges 96 and 97 of jaw 14, and first end 100 of clamping mechanism 16 grip conduit 18, thereby fixedly coupling it within body member 12. The distance between flanges 96 and 97 and first end 100 becomes slightly less than the diameter of the larger diameter conduit 18, as seen in FIG. 1. Flanges 96 and 97 and first end 100 put sufficient compression forces on conduit 18 to securely couple it within passageway 34 as in FIG. 1.

Alternatively, clamping mechanism 16 is rotated 90° into its second position, and smaller diameter conduit 18' is inserted into passageway 34 of body member 12.

After screws 81 and 82 are tightened, members 104 and 105 and flanges 96 and 97 of jaw 14 sufficiently grip the smaller diameter conduit 18' to securely couple it within body member 12.

The distance between flanges 96 and 97 and members 104 and 105 is slightly less than the diameter of the smaller diameter conduit 18', as seen in FIG. 2. Thus, flanges 96 and 97 and first end 100 put sufficient compression forces on conduit 18 to securely couple it within passageway 34 as in FIG. 2.

Therefore, clamping mechanism 16 is never lost because it is permanently coupled within body member 12. Furthermore, because clamping mechanism 16 rotates between first and second positions, electrical wiring device 10 may be reused as different size conduits are needed. Finally, because clamping mechanism 16 is shipped for use with large diameter conduit and because indicia 60 and 128 indicate which position 110 or 111 clamping mechanism 16 is in, large conduit is never damaged from attempting to insert it into a body member 12 having members 104 and 105 projecting into passageway 34.

SECOND EMBODIMENT OF CLAMPING MECHANISM OF FIGS. 6 AND 7

A second embodiment of the clamping mechanism, designated as **16*a*, is shown in FIGS. 6 and 7. Clamping mechanism 16***a* has a first end 200, a second end 202, first and second cylindrical portions 213 and 214, and first and second members 204 and 205.

First cylindrical portion 213 is located adjacent first end 200. Second cylindrical portion 214 is rigidly and unitarily coupled to first cylindrical portion 213 and extends from first cylindrical portion 213 to second end 202.

Preferably, clamping mechanism 16*a* has first and second members or teeth 204 and 205 extending perpendicularly and outwardly from first cylindrical portion 213 to grip a smaller diameter conduit 18' and securely couple it within passageway 34. However, one member is sufficient.

First and second members 204 and 205 are diametrically opposed and are tapered. Thus, they are the thickest where they are fixedly coupled to first cylindrical portion 213, and become narrower until they reach their end surfaces 216 and 217, respectively.

First and second end surfaces 216 and 217 are parallel, and spaced apart. Preferably, end surfaces 216 and 217 can be arcuately formed to centralize the smaller diameter conduit within passageway 34. However, end surfaces 216 and 217 are shown as flat in FIG. 7 and as discussed with respect to the first embodiment.

Second cylindrical portion 214 preferably has a smaller diameter than first cylindrical portion 213, acts as a rotating mechanism and has first and second ends.

The first end is fixedly and unitarily coupled to first cylindrical portion 213. The second end has a recess 224 or groove therein and indicia thereon (as previously discussed). Recess 224 typically receives a tool capable of providing rotary movement to clamping mechanism 16*a*, such as a screwdriver.

Clamping mechanism 16*a* rotates 90° between a first and second position. When clamping mechanism 16*a* is in its first position, first end 200 engages larger conduit 218. When clamping mechanism 16*a* is in its second position, first and second members 204 and 205 engage a smaller conduit. Thus, when in its first position, clamping mechanism 16*a* grips a conduit having a large diameter. When in its second position, members 204 and 205, which project outwardly from first end 200, engage a conduit 18 having a smaller diameter.

First cylindrical portion 213 also has a retention mechanism 230. As shown in FIGS. 6 and 7, retention mechanism 230 comprises an arcuate groove 232 which extends around 90° of the circumference of first cylindrical portion 213, has first and second ends 234 and 235, respectively, and receives extension 61 therein.

Extension 61 is formed in or extends into cut-out 49 of semi-cylindrical portion 38. As clamping mechanism 16*a* is rotated between the first and second positions, extension 61 is slidably received within arcuate groove 232 and acts as a stopping mechanism.

Extension 61 engages first end 234 of arcuate groove 232 when clamping mechanism 16*a* is in its first position. Extension 61 engages the second end 235 of arcuate groove 232 when clamping mechanism 16*a* is in its second position.

Clamping mechanism 16*a* operates just as clamping mechanism 16. However, extension 61 and groove 232 act to ensure that clamping mechanism 16*a* can only rotate 90°.

THIRD EMBODIMENT OF CLAMPING MECHANISM OF FIGS. 8 AND 9

A third embodiment of the clamping mechanism, designated as 16*b*, is shown in FIGS. 8 and 9. Clamping mechanism 16*b* has a first end 300, a second end 302, first and second cylindrical portions 313 and 314, and first and second members 304 and 305.

First cylindrical portion 313 is located at first end 300. Second cylindrical portion 314 is rigidly and unitarily coupled to first cylindrical portion 313 and extends from first cylindrical portion 313 to second end 302.

First end 300 has an annular groove 340 formed therein, and first, second and third members or teeth 341–343 are formed thereby. Alternatively, a circular groove can be formed in first end 300, thereby forming only first and second teeth 341 and 343.

Teeth 341–343 have end surfaces 316–318, respectively, and teeth 341 and 343 have side surfaces 346 and 347, respectively. End surfaces 316–318 may be flat or arcuate. Side surfaces 346 and 347 extend outwardly from first end 300. Side surfaces 346 and 347 are substantially flat, but taper inwardly toward end surfaces 316 and 318, respectively.

Second cylindrical portion 314 preferably has a smaller diameter than first cylindrical portion 113 and acts as a rotating mechanism 320. Rotating mechanism 320 has a first and second end 325 and 326.

First end 325 is fixedly and unitarily coupled to first cylindrical portion 313. Second end 326 has a recess 324 therein and indicia thereon.

Recess 324 typically extends across a diameter of second cylindrical portion 314, and receives a tool capable of providing rotary movement to clamping mechanism 16*b*.

Clamping mechanism 16*b* rotates 90° between first and second positions.

When clamping mechanism 16*b* is in its first position as seen in FIGS. 8 and 9, end surface 317 of second tooth 342 and side surfaces 346 and 347 of first and third teeth 341 and 343 engage conduit 318. When clamping mechanism 16*b* is in its second position (not shown), end surfaces 316 and 318 of first and third teeth 341 and 343 engage conduit 318, respectively.

Clamping mechanism 16*b* operates similarly to clamping mechanism 16. When clamping mechanism 16*b* is in its first position, flanges 96 and 97 of jaw 14 and end surface 317 of second tooth 342 and side surfaces 346 and 347 of first and third teeth 341 and 343 put sufficient compression forces on large diameter conduit 318 to securely couple it within passageway 34, as in FIG. 8.

Alternatively, clamping mechanism 16*b* may be rotated 90° into its second position (not shown). End surfaces 316 and 318 of teeth 341 and 343, extending outwardly from first end 300 of clamping mechanism 16*b*, and flanges 96 and 97 of jaw 14 put sufficient compression forces on a smaller diameter conduit to securely couple it within passageway 34.

FOURTH EMBODIMENT OF CLAMPING MECHANISM OF FIG. 10

Figure 10:
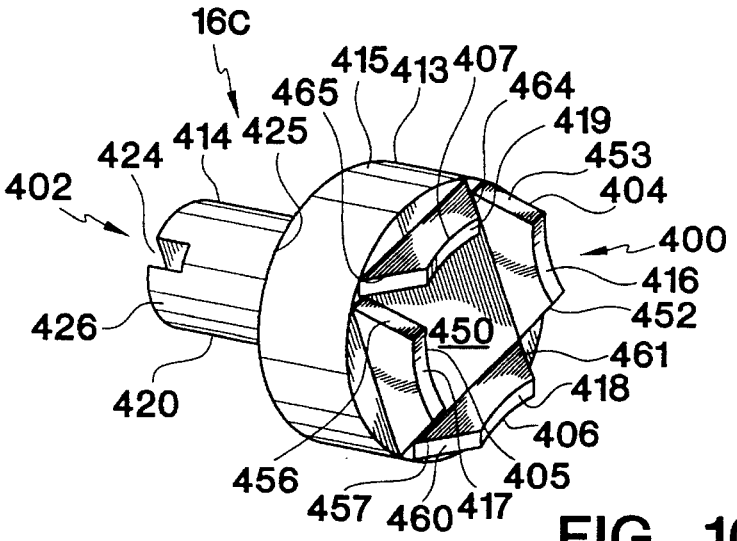
FIG. 10 is a perspective view of a fourth embodiment of the clamping mechanism.

A fourth embodiment of the clamping mechanism, designated as 16*c*, is shown in FIG. 10. Clamping mechanism 16*c* has a first end 400, a second end 402, first and second cylindrical portions 413 and 414, and first and second members 404 and 405.

First cylindrical portion 413 is located at first end 400. Second cylindrical portion 414 is rigidly and unitarily coupled to first cylindrical portion 413 and extends from first cylindrical portion 413 to second end 402.

First cylindrical portion 413 has a flat end surface 450. First, second, third and fourth members or teeth 404–407 extend perpendicularly outwardly from flat end surface 450. First and second members 404 and 405, respectively, extend further outwardly than third and fourth members 406 and 407, and are diametrically opposed. Third and fourth members 406 and 407, respectively, are also diametrically opposed.

Each one of members 404–407 has two side surfaces. First member 404 has side surfaces 452 and 453, second member 405 has side surfaces 456 and 457, third member 406 has side surfaces 460 and 461, and fourth member 407 has side surfaces 464 and 465.

Each set of side surfaces tapers slightly inwardly toward each other until reaching its corresponding end surface 416–419, respectively. End surfaces 416–419 are preferably slightly arcuate to centralize smaller conduit within passageway 34.

Second cylindrical portion 414 preferably has a smaller diameter than first cylindrical portion 413 and acts as a rotating mechanism 420. Rotating mechanism 420 has a first and second end 425 and 426. First end 425 is fixedly and unitarily coupled to first cylindrical portion 413. Second end 426 has a recess 424 therein and indicia thereon. Recess 424 typically extends across a diameter of second cylindrical portion 414, and receives a tool capable of providing rotary movement to clamping mechanism **16*c*. Clamping mechanism 16*c* rotates 90° between a first and second position 410 and 411. When clamping mechanism 16*c* is in its first position, third and fourth members 406 and 407 engage conduit 18. When clamping mechanism 16*c* is in its second position, first and second members 404 and 405 engage conduit 18. Thus, when in its first position, members 406 and 407 grip a conduit having a large diameter. When in its second position, members 404 and 405, which project further outwardly than members 406 and 407**, engage a conduit having a smaller diameter.

Clamping mechanism **16*c* operates similarly to clamping mechanism 16. When clamping mechanism 16*c* is in its first position, flanges 96 and 97 of jaw 14 and end surfaces 418 and 419 of members 406 and 407, respectively, put sufficient compression forces on large diameter conduit 18 to securely couple it within passageway 34**.

Alternately, clamping mechanism **16*c* may be rotated 90° into its second position. End surfaces 416 and 417 of members 404 and 405, respectively, and flanges 96 and 97 of jaw 14 put sufficient compression forces on smaller diameter conduit to securely couple it within passageway 34**.

FIFTH EMBODIMENT OF CLAMPING MECHANISM OF FIGS. 13–18

As seen in FIGS. 13–18, an additional embodiment of the invention is shown as electrical wiring device 500. Device 500 is similar to device 10 shown in FIGS. 1–5 except that a series of teeth or detents are used to resist and prevent unwanted rotational movement of the clamping mechanism out of its clamping orientation.

Electrical wiring device 500 comprises a connector 511, a clamping mechanism 516, and a movable clamping jaw 514. Connector 511 has electrical contacts 562–564 at the bottom and a passageway 534 therein for reception of a large diameter electrical conduit or a small diameter conduit 518' as seen in FIG. 13.

To prevent unwanted rotational movement of the clamping mechanism 516, a locking mechanism comprising a first series or set of teeth 519 is located on the clamping mechanism in a substantially arcuate and circular array and a second series or set of teeth 520 is located on the housing in the connector 511 in an arcuate array encompassing substantially 225°. These series of teeth are angled in opposite circumferential directions and mesh when the clamping mechanism is fully received in the connector, this meshing engagement increasing when jaw 514 is moved towards connector 511 under the influence of tightening screws 521 and 522 as seen in FIG. 13.

Figure 13:
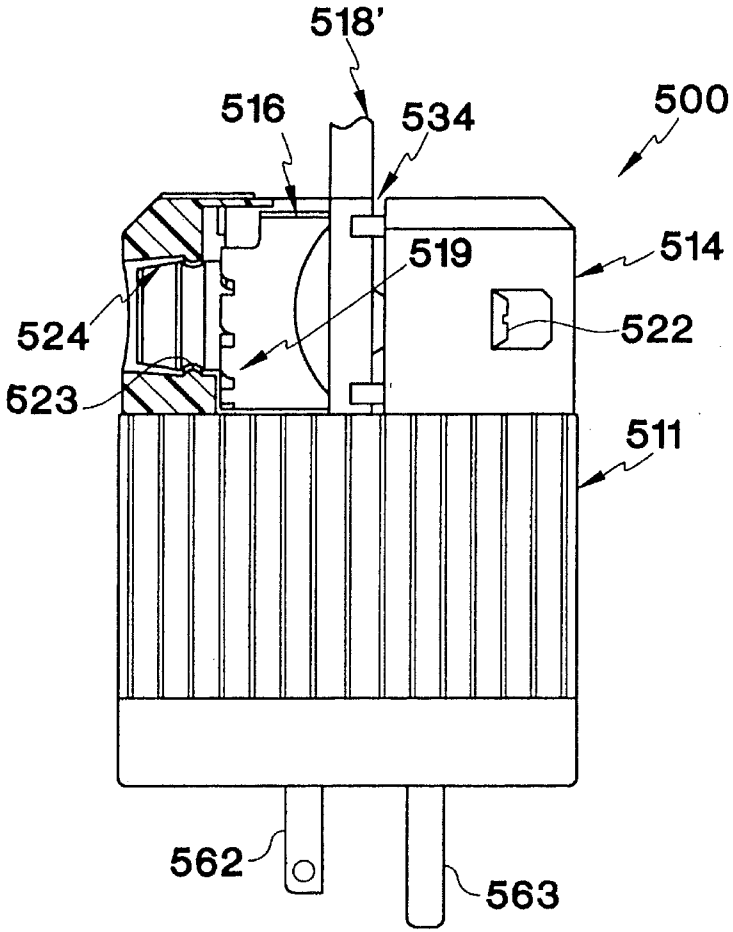
FIG. 13 is a side elevational view in partial section of a fifth embodiment of the invention in which the clamping mechanism and connector have mating series of teeth to resist relative rotation therebetween.

Thus, when these series of teeth mesh, relative rotational movement of the clamping mechanism 516 in a direction tending to move the clamping mechanism from the position shown in FIG. 13 to one in which a larger diameter conduit can be clamped is resisted. In other words, the series of teeth comprise a ratchet tending to prevent relative rotation in one direction. These teeth also tend to prevent rotation in the opposite direction until they are disengaged.

Clamping mechanism 516 is free to slightly translate axially relative to connector 511 a sufficient distance to disengage the series of teeth so that clamping mechanism can be rotated freely by a tool, such as a screwdriver. The push to translate the clamping mechanism out of tooth engagement, prior to conduit engagement, is intuitively applied when using the screwdriver and is provided by axial dimensional slack between extension or ring 523 in bore 524 in the connector and annular recess 525 on the clamping mechanism, which are snap-fitted together and which limits such relative axial movement. As noted above, the force applied to the conduit by the clamping jaw moves the clamping mechanism back again and firmly engages the first and second series of teeth.

Rather than using the teeth shown in FIGS. 13–16, a first and second series of 45° cams can be used on the connector and on the clamping mechanism, in which case resistance to rotation in both directions would be present. Alternatively, a dog clutch mechanism can be used to resist relative rotation comprising mating axially extending pins and axially extending recesses in the clamping mechanism and connector, which would essentially prevent relative rotation until the pins and recesses were axially disengaged upon relative axial movement of the connector and clamping mechanism.

While only five embodiments have been chosen to illustrate the invention, it will be understood by those skilled in the art that various changes and modifications can be made herein without departing from the scope of the invention as defined in the appended claims.

What is claimed is:

1. An electrical wiring device, the combination comprising:

a housing having a longitudinal axis, and a passageway for receiving an electrical conduit therein, said passageway having a wall;

clamping means, coupled to said housing for rotary movement, for selectively clamping electrical conduits having different diameters against said wall, said clamping means having a first end and a second end, said clamping means having a first member coupled thereto at said first end, said clamping means having a first position and a second position, said first end clamping an electrical conduit having a large diameter when said clamping means is in said first position and said first member clamping an electrical conduit having a smaller diameter when said clamping means is in said second position;

locking means, coupled to said housing and clamping means, for preventing relative rotational movement of said clamping means and said housing; and means, coupled to said housing and clamping means, for engaging and disengaging said locking means to selectively prevent and allow movement of said clamping means between said first and second position.

2. An electrical wiring device as claimed in claim 1, wherein said locking means comprises a first set of teeth on said housing and a second set of teeth on said clamping means.

3. An electrical wiring device as claimed in claim 1, wherein said means for engaging and disengaging said locking means comprises means for allowing said clamping means to move slightly axially relative to said housing.

4. An electrical wiring device as claimed in claim 3, wherein said means for allowing comprises a curvilinear recess and an extension received therein.

5. An electrical wiring device as claimed in claim 3, wherein said locking means comprises a first set of teeth on said housing and a second set of teeth on said clamping means.

6. An electrical wiring device as claimed in claim 5, wherein said first and second sets of teeth are each configured in an arcuate array.

7. An electrical wiring device as claimed in claim 1, wherein said clamping means has a first cylindrical portion and rotates 90° between said first and second positions, said first cylindrical portion having an outer surface.

8. An electrical wiring device as claimed in claim 7, wherein said clamping means has a second member coupled to said first end, said first and second members being diametrically opposed for gripping the smaller diameter conduit, said first and second members having flat end surfaces.

9. An electrical wiring device as claimed in claim 8, wherein said housing has an extension coupled thereto, and said clamping means has a retention means for receiving said extension, thereby limiting the rotary movement of said clamping means to 90°.

10. An electrical wiring device as claimed in claim 9, wherein said retention means is an arcuate groove, has a first and second end, and extends substantially 90° around the circumference of said clamping means.

11. An electrical wiring device as claimed in claim 8, wherein said flat end surfaces are arcuate to centralize the smaller diameter cord within said passageway.

12. An electrical wiring device as claimed in claim 11, wherein said first and second members form a circular groove in said first end.

13. An electrical wiring device as claimed in claim 11, wherein said first end has a third member coupled thereto and extending outwardly therefrom for clamping the larger diameter conduit, said first and second members having side surfaces for clamping the larger diameter conduit, and extending further outwardly from said first end than said third member, said first and second members being diametrically opposed and said third member being spaced between said first and second members.

14. An electrical wiring device as claimed in claim 13, wherein said first end has an annular groove therein, thereby forming said third member.

15. An electrical wiring device as claimed in claim 11, wherein said first end has third and fourth members coupled thereto, extending outwardly therefrom for clamping the larger diameter conduit, and being diametrically opposed, all of said members being alternately positioned at 90° intervals around the circumference of said clamping means, said first and second members extending further outwardly from said first end than said third and fourth members.

16. An electrical wiring device as claimed in claim 11, wherein said clamping means has a rotating means at said second end.

17. An electrical wiring device as claimed in claim 16, wherein said rotating means includes a second cylindrical portion having a recess therein for receiving a tool which may impart rotary movement to said clamping means.

18. An electrical wiring device as claimed in claim 1, wherein said body has indicia thereon corresponding to said first and second positions of said clamping means.

19. An electrical wiring device as claimed in claim 1, wherein said clamping means has indicia thereon indicating which of said positions said clamping means is in.

20. An electrical wiring device, the combination comprising:

a housing having a longitudinal axis, and a passageway for receiving an electrical conduit therein, said passageway having a wall;

clamping means, coupled to said housing, for selectively clamping electrical conduit having different diameters against said wall, said clamping means having a first end, a second end, a cylindrical portion, and a clamping means longitudinal axis, said clamping means longitudinal axis substantially intersecting said longitudinal axis of said housing, said clamping means having diametrically opposed first and second members extending outwardly from said first end, said clamping means having a first position and a second position, said first end clamping an electrical conduit having a large diameter when said clamping means is in said first position, and said first and second members clamping an electrical conduit having a smaller diameter when said clamping means is in said second position; and means for coupling said clamping means to said housing for rotary and limited axial movement.

21. An electrical wiring device as claimed in claim 20, and further comprising an extension coupled to said clamping means, and a pair of stops defining a recess therebetween on said housing for receiving said extension therein, said stops being spaced about 90° apart.

22. An electrical wiring device, the combination comprising:

a housing having a longitudinal axis, and a passageway for receiving an electrical conduit therein, said passageway having a wall;

clamping means, coupled to said housing, for selectively clamping electrical conduit having different diameters against said wall, said clamping means having a first end, a second end, and a cylindrical portion, said clamping means having diametrically opposed first and second members extending outwardly from said first end, said clamping means having a first position and a second position, said first end clamping an electrical conduit having a large diameter when said clamping means is in said first position, and said first and second members clamping an electrical conduit having a smaller diameter when said clamping means is in said second position; and means for coupling said clamping means to said housing for rotary and limited axial movement, said means for coupling comprises an annular recess on said clamping means and annular ring on said housing and receivable in said recess.

* * * * *